US006027212A

United States Patent [19]

Tanno et al.

[11] Patent Number: 6,027,212

[45] **Date of Patent: *Feb. 22, 2000**

[54] SWITCHING MECHANISM AND A RECORDING APPARATUS USING SAID SWITCHING MECHANISM

[75] Inventors: Koichi Tanno, Kawasaki; Tetsuo Suzuki, Yokohama; Haruyuki Yanagi, Machida; Hiroyuki Kinoshita, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/634,990

[22] Filed: Apr. 19, 1996

[30] Foreign Application Priority Data

Apr. 21, 1995 [JP] Japan ..... 7-097190
Jul. 31, 1995 [JP] Japan ..... 7-195201

[51] Int. Cl.[7] ..... B41J 29/13

[52] U.S. Cl. ..... 347/108

[58] Field of Search ..... 347/108, 23, 29, 347/37, 3; 346/145; 400/691–693, 207, 248.1, 248.2, 250; 200/332, 335, 337, 518

[56] References Cited

U.S. PATENT DOCUMENTS 5,142,113 8/1992 Miyata ..... 200/559
5,459,496 10/1995 Hanabusa et al. ..... 347/5

FOREIGN PATENT DOCUMENTS 60-19577 6/1985 Japan .
60-255473 12/1985 Japan .
5-325729 12/1993 Japan .

*Primary Examiner*—N. Le
*Assistant Examiner*—L. Anderson
*Attorney, Agent, or Firm*—Fitzpatrick, Cella, Harper & Scinto

[57] ABSTRACT

A recording apparatus is of a type which operates in combination with a recording head, the recording apparatus comprises a housing, a carriage for reciprocating the recording head carried thereon, an accommodation space for accommodating a reciprocative movement area of the carriage, disposed inside the housing, a cover member for opening or closing at least part of the accommodation space to the outside of the housing, an opening portion for communicating at least part of the accommodation space to the outside of the housing, formed by a relative displacement of the cover member from the housing, and an operation unit for operating the movement of the carriage from outside the housing via the opening portion and the accommodation space. The operation unit controls movement of the carriage to a position within the accommodation space in communication to the outside of the housing via the opening portion.

43 Claims, 15 Drawing Sheets

SWITCHING MECHANISM AND A RECORDING APPARATUS USING SAID SWITCHING MECHANISM

BACKGROUND OF THE INVENTION

1. Field of the Invention

The present invention relates to a recording apparatus in which the printing members such as an ink holding member, a recording head, or a recording head integral with an ink holding member, which are exchangeable or mountable/dismountable for use with the recording apparatus, are mounted on a moving carriage. In particular, this invention relates to a construction which is effective in practice in exchanging of mounting/dismounting said printing members.

The invention is applicable at will to various types of terminals or a printer singly.

2. Related Background Art

Conventionally, a recording apparatus has been disclosed in which the printing members such as an ink ribbon cassette, an ink tank, and a recording head, which are exchangeable or mountable/dismountable for use with the recording apparatus, are mounted on a serially moving carriage, such that the printing members can be exchanged on a carriage within an inner area apart from the end but not at the end in a scanning direction of the carriage, in Japanese Laid-Open Patent Application No. 60-255473 filed by the present applicant as an invention for enhancing the operability for the user to exchange or mount/dismount them.

On the other hand, an operation panel of a typical recording apparatus is normally laid on an outer casing of an apparatus housing, to allow the recording apparatus to be operated from the outside. This operation panel is provided with a power supply key or various operation keys for the printing members, e.g., a recovery operation key for enabling ink discharge with the suction or driving of an ink jet head in an ink jet printer as one of the recording apparatuses, wherein such keys are arranged adjacent each other to allow for the centralized processing.

It can be considered that an operation key for instructing the exchange as described in the above publication is provided on the operation panel of conventional recording apparatus, but a new problem may arise if this setting is made. For example, taking an ink jet printer as an example, the occurrence frequency of the normal on/off of power supply or the above recovery processing is relatively large, as compared with that of the exchange or mounting/dismounting of the ink jet printing members on the carriage, and therefore, there is a relatively high frequency that the operator manipulates the keys on the operation panel. In this case, because the keys are arranged closely, there was a new problem that the operation key for effecting the exchange might be manipulated by mistake in manipulating other keys.

In this way, if the exchange key for the ink jet printing members, other than necessary operations, is manipulated by mistake, the effect of the key to be operated inherently can not be obtained, and further there occurs waste of time due to wasteful movement of the carriage, or the waste of ink consumption (partial small recovery) when the carriage returns to the end, resulting in the delay of the ink jet printing, as such. Accordingly, it is important to resolve this new problem.

Also, typically, when a plurality of electrical connecting elements are attached on an electric circuit board, it is common that each connecting element is oriented in the same direction, whereby if a pressing force is passed from a switch button disposed at a location on a different plane to the elements with such a constitution, its transmission mechanism may be complicated.

On the other hand, since the ink jet printer is required to be miniaturized, there is almost no excess space left for the mechanism outside the carriage movement area. The centralization of the operation keys on the operation panel is an effective constitution from this viewpoint. However, taking into account the occurrence of the new problem as above described, it was desired to resolve the above problem, and at the same time accomplish the miniaturization of the printer.

SUMMARY OF THE INVENTION

An object of the present invention is to provide a recording apparatus in which an operation key for moving a carriage to an exchange region for the exchange or mounting/dismounting of the printing members provided at a position received within a printer in a closed state of an opening/closing member, and operable in an open state thereof, can be operated only when the opening/closing member is in the open state.

It is another object of the present invention to provide a recording apparatus of a type which operates in combination with a recording head, the recording apparatus comprising,

- a housing;
- a carriage for reciprocating the recording head carried thereon;
- an accommodation space for accommodating a reciprocative movement area of the carriage, disposed inside the housing;
- a cover member for opening or closing at least part of the accommodation space to the outside of the housing;
- an opening portion for communicating at least part of the accommodation space to the outside of the housing, formed by a relative displacement of the cover member from the housing; and
- an operation unit for operating the movement of the carriage from outside the housing via the opening portion and the accommodation space, the operation unit moving the carriage to a position within the accommodation space in communication to the outside of the housing via the opening portion.

BRIEF DESCRIPTION OF THE DRAWINGS

FIGS. 5A and 5B are front views for a carriage unit of the printer as the example according to the present invention, wherein FIG. 5A shows a state before a head cartridge 7 is completely attached, and FIG. 5B shows a state where it has been completely attached.

FIGS. 8A and 8B are explanatory views for the constitution of a main portion of a head mounting/dismounting mechanism of the printer as the example according to the present invention, wherein FIG. 8A is a plan view and FIG. 8B is a front view.

FIGS. 9A and 9B are views for explaining the constitution of a head fitting pin of the printer as the example according to the present invention, wherein FIG. 9A and FIG. 9B are enlarged views of the fitting pin provided at different positions, respectively.

FIGS. 10A to 10C are views for explaining the built-in state of the leading end of a flexible substrate of the printer as the example according to the present invention, wherein FIG. 10A shows a state where the leading end 562 has been built in, and FIG. 10B and FIG. 10C show the states where the leading end is during the insertion process.

DETAILED DESCRIPTION OF THE PREFERRED EMBODIMENTS

The present inventors have provided, prior to this application, an invention to solve a problem with the contact between a head and a conveying system which may arise when the apparatus is miniaturized by placing exhausting means of recording medium closer to the carriage in exchanging the ink jet printing members from the carriage. At first, this constitution including an example of the present invention will be briefly described below.

Figure 1:
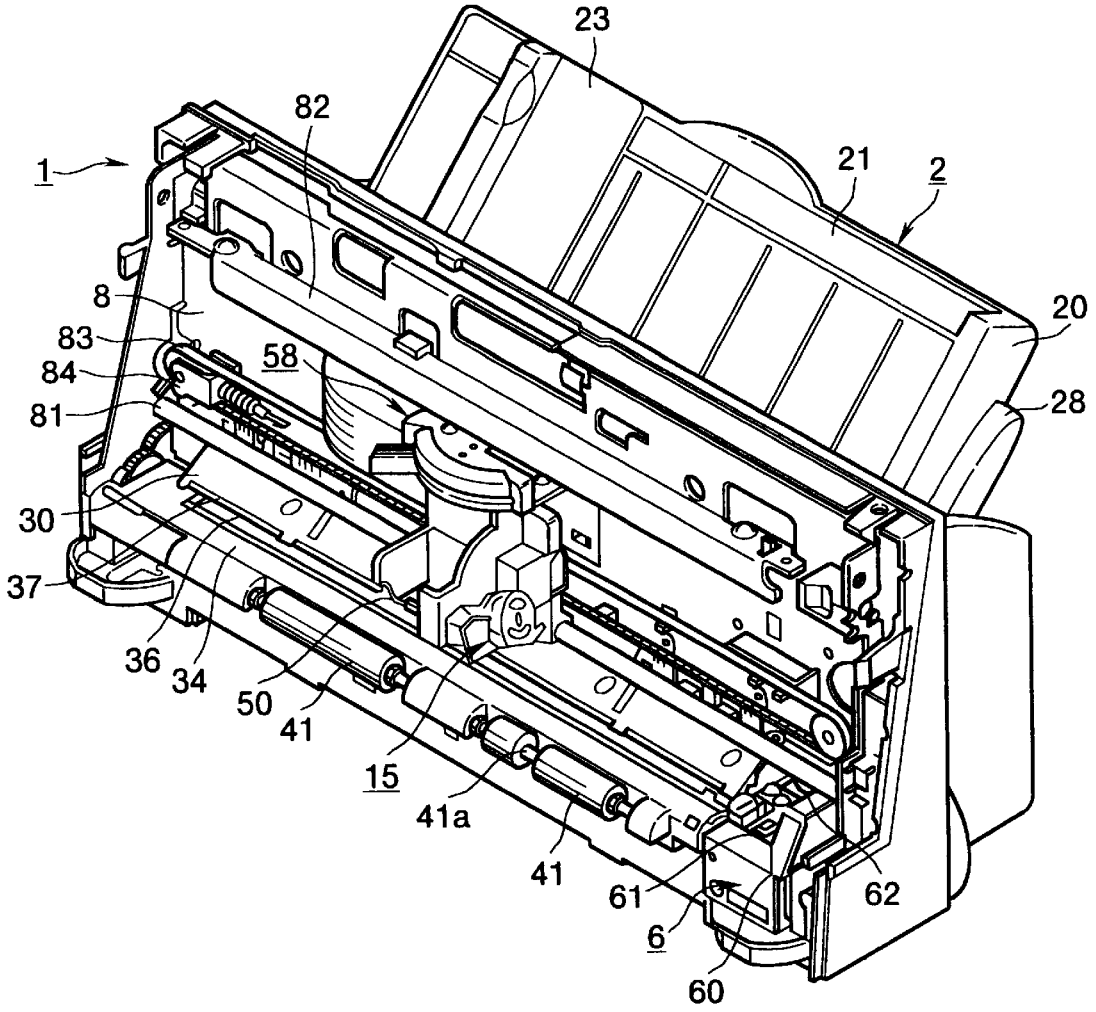
FIG. 1 is a perspective view illustrating the overall constitution of a printer as an example to which the present invention is applied.
Figure 2:
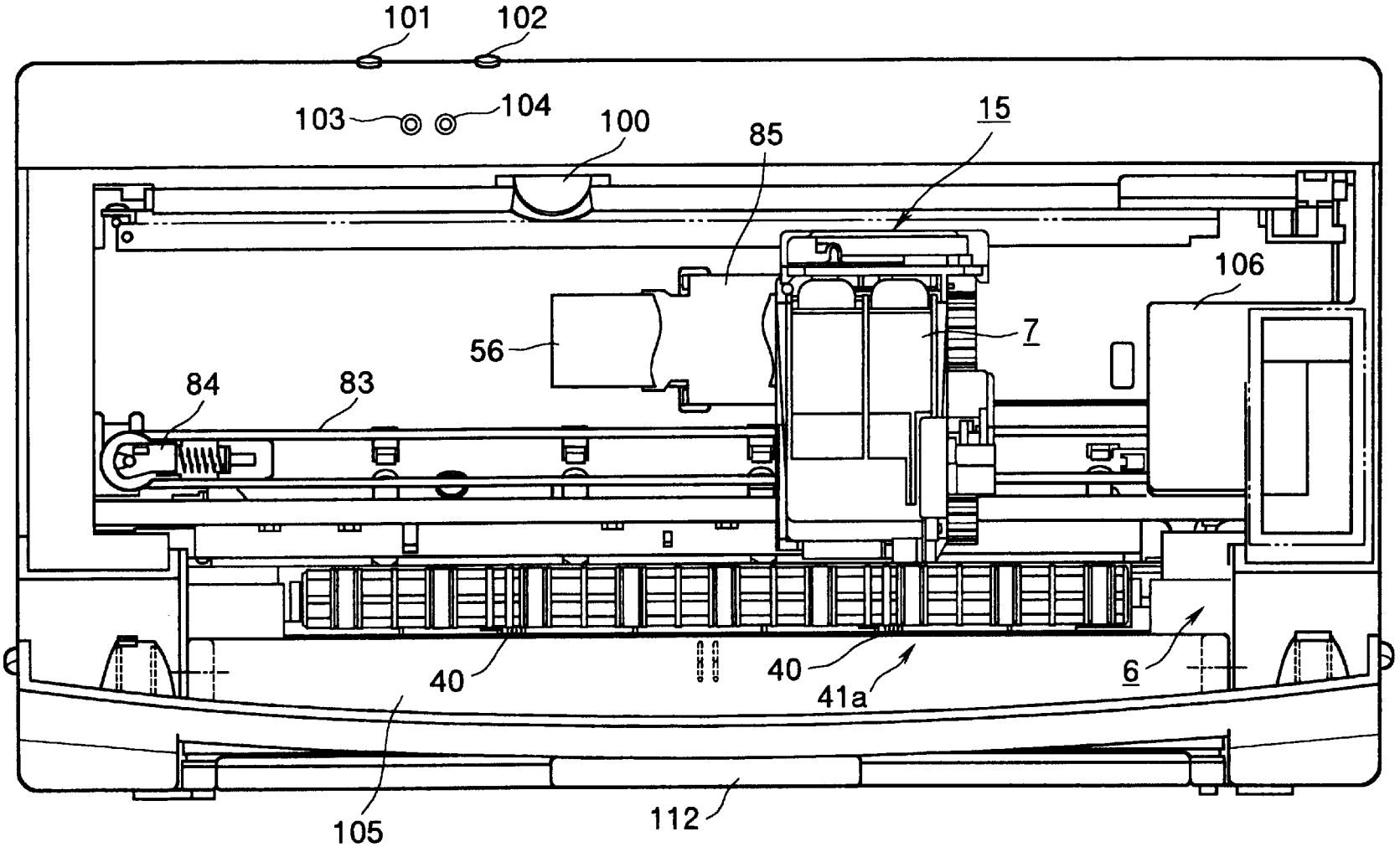
FIG. 2 is a front view of the printer as the example to which the present invention is applied.
Figure 3:
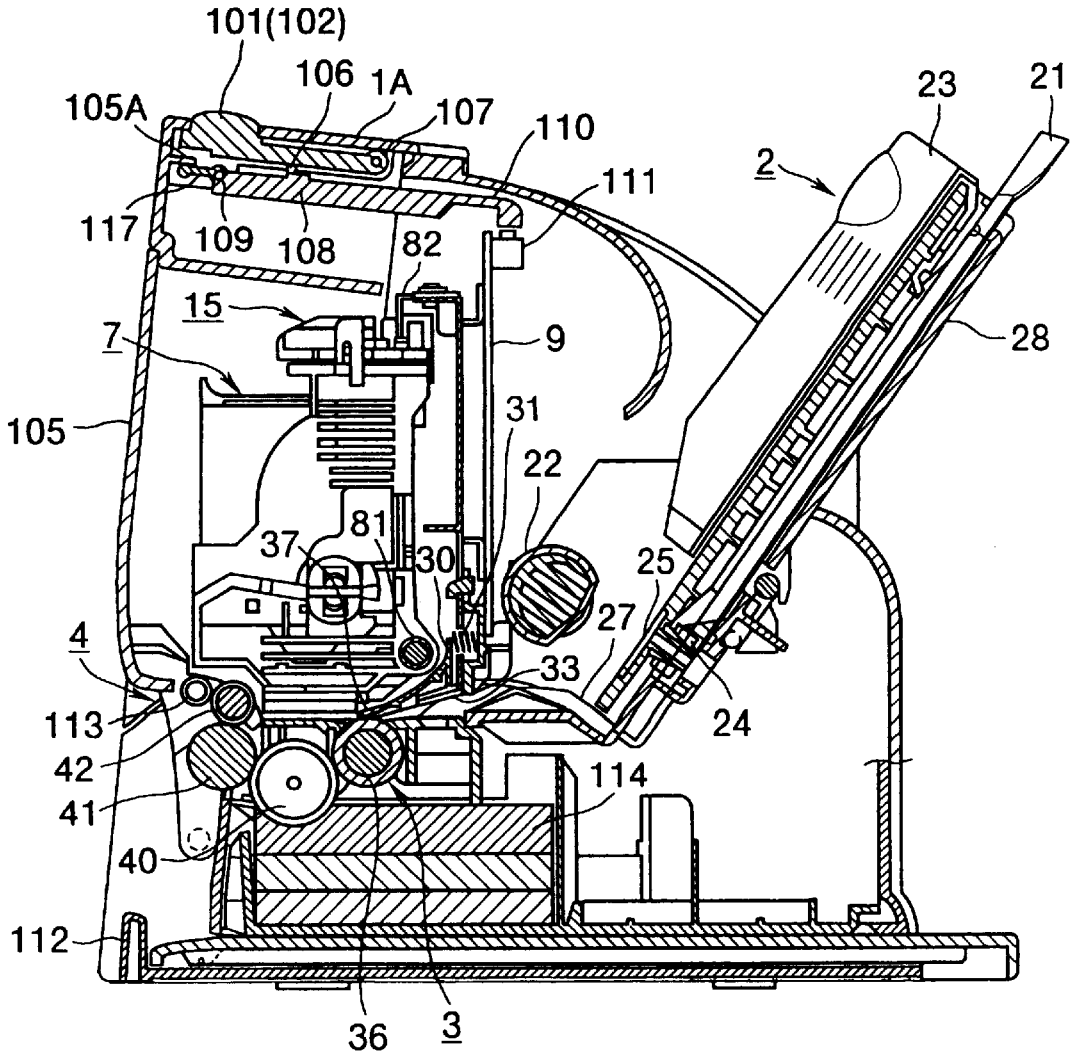
FIG. 3 is a side cross-sectional view of the printer as the example to which the present invention is applied.

The schematic constitution of a printer as an example according to the present invention will be first described with reference to FIGS. 1 to 3. FIG. 1 is a perspective view showing the overall constitution of the printer 1, FIG. 2 is a front view of the printer 1, and FIG. 3 is a side cross-sectional view of the printer 1.

The printer 1 having an automatic paper feeder is constituted of a paper supply unit 2, a paper feeding unit 3, a paper exhausting unit 4, a carriage unit 15 and a cleaning unit 6. Thus, each unit will be schematically described below successively.

(A) Paper Supply Unit

The paper supply unit 2 is configured to have a pressure plate 21 for loading the recording sheets thereon and a supply body of revolution 22 for supplying a recording sheet, both of which are attached to a base 20. The pressure plate 21 is movably provided with a movable side guide 23 to regulate the loading position of the recording sheet. The pressure plate 21 is rotatable around a shaft connected to the base 20, and biased toward the supply body of revolution 22 by a pressure plate spring 24. Provided at a portion of the pressure plate 21 facing the supply body of revolution 22 is a separating pad 25 made of a material having a large frictional coefficient such as an artificial leather to prevent the recording sheet from moving under the gravitational force. Further, disposed on the base 20 are a separation pawl (not shown) for separating the recording sheets one by one by engaging the corner of the recording sheet in one sense, a bank portion (not shown) formed integrally with the base 20 for separating cardboards or the like which can not be separated by the separation pawl, a switch lever 28 for switching the separation pawl between the plain paper position and the cardboard position where it is ineffective, and a release cam for releasing the contact between the pressure plate 21 and the supply body of revolution 22.

With the above constitution, the release cam 29 forces the pressure plate 21 upward to a predetermined position in a standby state. Thereby, the contact between the pressure plate 21 and the supply body of revolution 22 is released. In this state, if a drive force provided by a conveying roller 36 is transmitted via the gears to the supply body of revolution 22 and the release cam 29, the release cam 29 leaves away from the pressure plate 21 to cause the pressure plate 21 to rise, so that the recording sheet is placed into contact with the supply body of revolution 22, thus picked up with the rotation of the supply body of revolution 22, starting the supply of paper, separated one by one by the separation pawl, and delivered to the paper feeding unit 3. The supply body of revolution 22 and the release cam 29 are rotated until the recording sheet is delivered into the paper feeding unit 3, thereby coming to the standby state where the contact between the recording sheet and the supply body of revolution 22 is released, so that the driving force from the conveying roller 36 is disconnected.

(B) Paper Feeding Unit

The paper feeding unit 3 is comprised of the conveying roller 36 for conveying the recording sheet and a PE sensor (not shown). The conveying roller 36 is provided in contact with a pinch roller 37 which is driven. The pinch roller 37 is held on a pinch roller guide 30, which is biased by a pinch roller spring 31 to force the pinch roller 37 into contact with the conveying roller 36, thereby producing a conveying force for the recording sheet. Further, at the entrance of the paper feeding unit 3 into which the recording sheet P is conveyed, an upper guide 33 for guiding the recording sheet and a platen (not shown) are disposed. Also, the upper guide 33 is provided with a PE sensor lever (not shown) for transmitting the sensing of the leading and trailing end of the recording sheet P to the PE sensor. Further, a head cartridge 7 for forming the image based on image information is provided downstream of the conveying roller 36 in a recording sheet conveyance direction.

With the above constitution, the recording sheet delivered to the paper feeding unit 3 is fed to a pair of rollers consisting of the conveying roller 36 and the pinch roller 37, guided by the platen, the pinch roller guide 30 and the upper guide 33. At this time, the PE sensor lever senses the leading end of the recording sheet which has been conveyed, thereby to determine the print position of the recording sheet. Also, the recording paper is conveyed on the platen as the pair of rollers 36, 37 are rotated by an LF motor, not shown.

Figure 4:
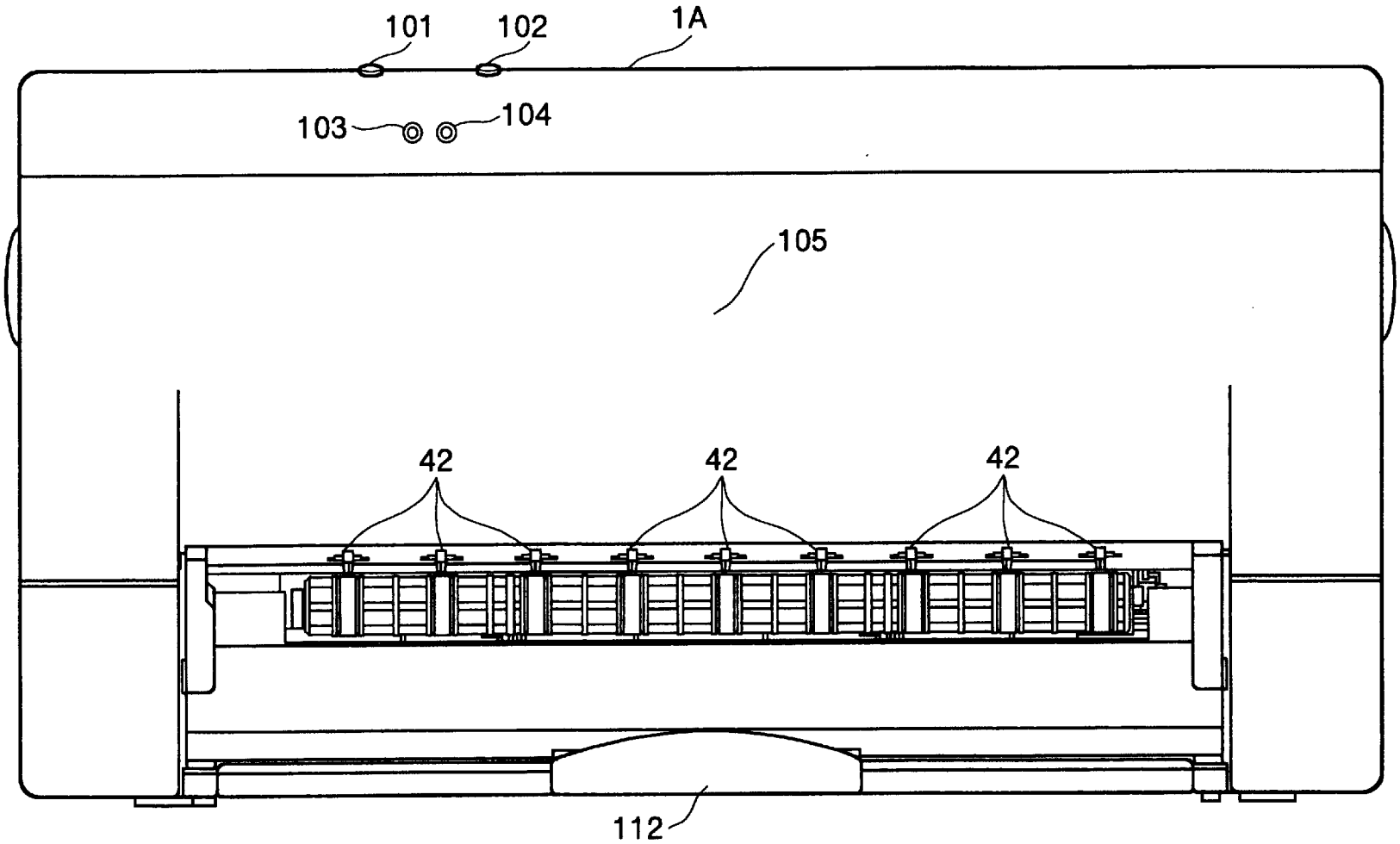
FIG. 4 is a front view of the printer as the example to which the present invention is applied.

Note that the head cartridge 7 is an easily replaceable ink jet recording head which is integrally formed with an ink tank. The recording head can apply heat to the ink by means of electricity-heat converters such as heaters. And owing to this heat, the ink causes film boiling, which produces pressure changed by growth or shrinkage of bubbles, so that the ink is discharged through the nozzles 70 of the recording head to form the image on the recording sheet P, as shown in FIG. 4.

(C) Carriage Unit

Figure 5A:
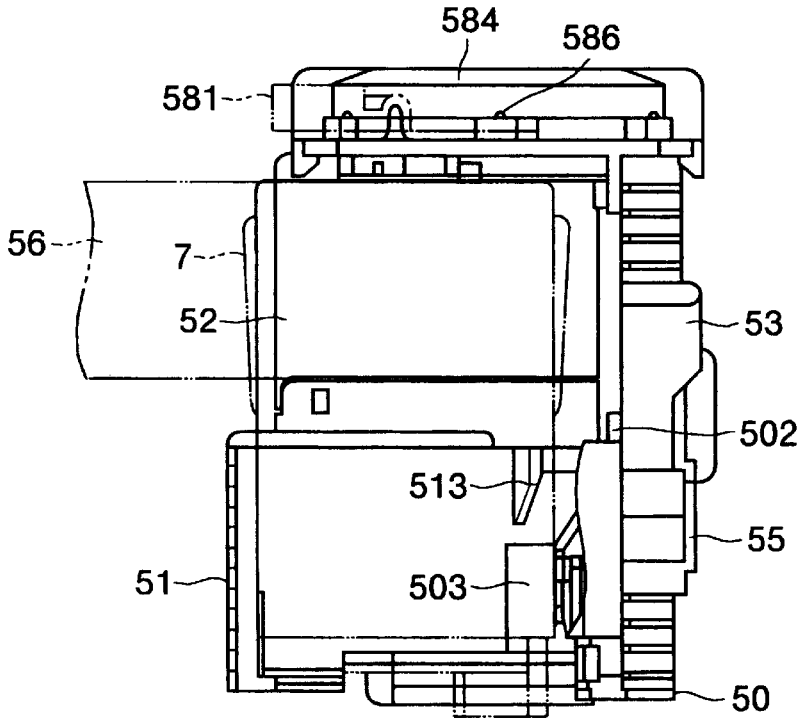
Figure 5B:
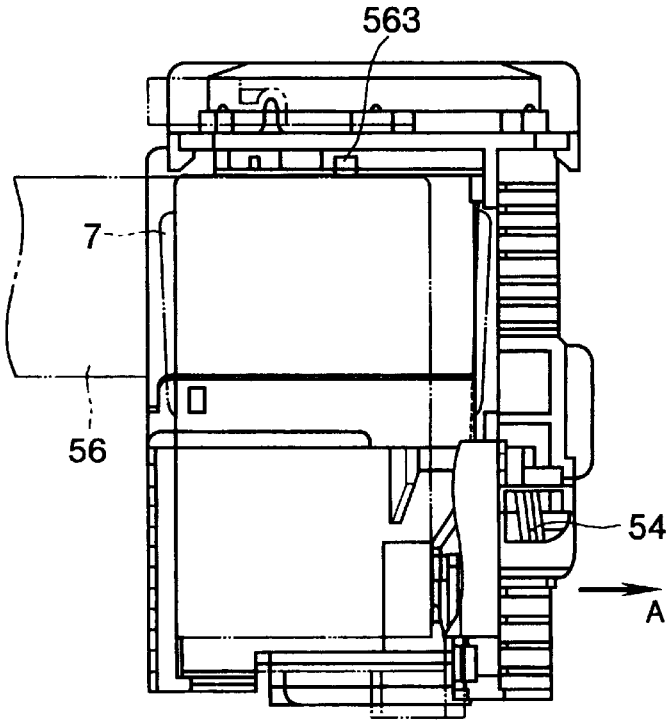

The carriage unit 15 has a carriage 50 on which the head cartridge 7 is mounted. And the carriage 50 is supported by a guide shaft (not shown) for scanning reciprocally in the directions at right angles to the conveyance direction of the recording sheet, and a guide rail 82 for maintaining a gap between the head cartridge 7 and the recording sheet P by holding the upper trailing end of the carriage 50. Note that the guide shaft and the guide rail 82 are attached to a chassis 8. Also, the carriage 50 is driven via a timing belt 83 by a carriage motor (not shown) attached to the chassis 8. This timing belt 83 is extended and supported by an idle pulley 84. Further, the carriage 50 comprises a flexible substrate 56 as shown in FIGS. 5A and 5B for passing a head signal from the electrical substrate 9 to the head cartridge 7.

With the above constitution, in forming the image on the recording sheet, the pair of rollers 36, 37 convey the recording sheet to a line position forming the image (in the conveyance direction of the recording sheet), while the carriage 50 is moved to a column position forming the image (in a direction perpendicular to the conveyance direction of the recording sheet) by a carriage motor, so that the head cartridge 7 is placed opposed to the image forming position. Thereafter, the head cartridge 7 discharges the ink onto the recording sheet upon a signal from the electrical substrate 9 to form the image.

(D) Paper Exhausting Unit

The paper exhausting unit 4 has a transmission roller 40 in contact with the conveying roller 36 and a paper exhausting roller (not shown) in contact with the transmission roller 40. Accordingly, a drive force of the conveying roller 36 is transmitted via the transmission roller 40 to the paper exhausting roller. Also, a spur 42 is placed into contact with the paper exhausting roller 41 to be rotatable by being driven by the paper exhausting roller. With the above constitution, the recording sheet having image formed at the carriage unit 15 is carried at a nip between the paper exhausting roller and the spur 42, and conveyed and exhausted onto a paper exhausting tray.

(E) Cleaning Unit

The cleaning unit 6 is comprised of a pump 60 for cleaning the head cartridge 7, a cap 61 for preventing drying of the head cartridge 7, and a drive switching arm 62 for switching the driving force from the conveying roller 36 between the paper supply unit 2 and the pump 60. The drive switching arm 62 fixes a planetary gear (not shown) rotating around the shaft of the conveying roller 36 at a predetermined position, except when in the paper supply and cleaning operation, so that no driving force is transmitted to the paper supply unit 2 and the pump 60. If the carriage 50 is moved to shift the drive switching arm 62 in a direction of the arrow A, the planetary gear can be free, so that the planetary gear can be moved in accordance with the forward or backward rotation of the conveying roller 36, whereby when the conveying roller 36 is rotated in a forward direction, the driving force is transmitted to the paper supply unit 2, or when rotated in a backward direction, the driving force is transmitted to the pump 60.

Next, the main components of the carriage unit 15 and the paper exhausting roller corresponding to paper exhausting means of the paper exhausting unit 4 will be described in detail.

Figure 6:
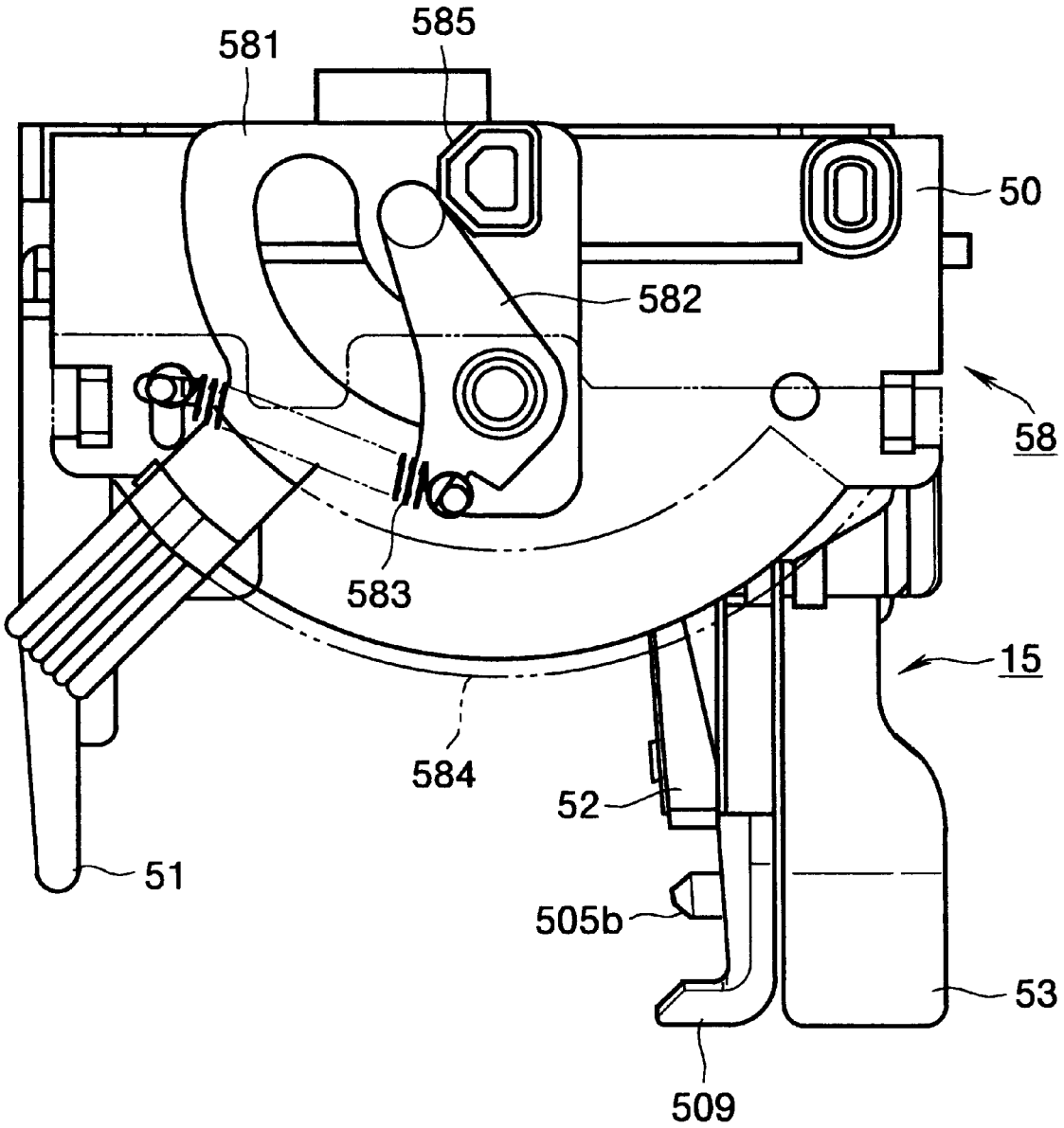
FIG. 6 is a plan view of the carriage unit of the printer as the example according to the present invention.
Figure 7:
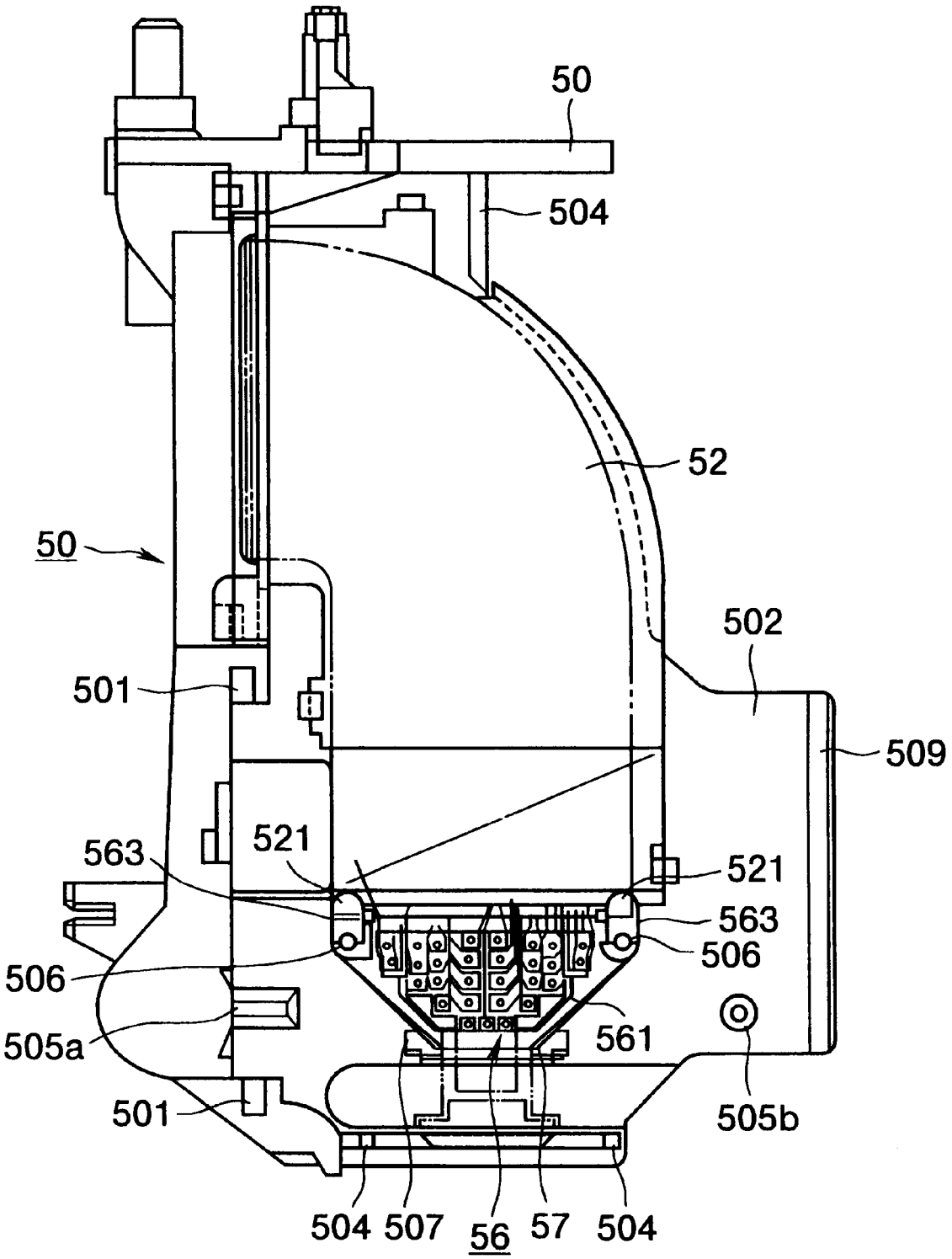
FIG. 7 is an explanatory view for the constitution of a contact portion of the carriage unit of the printer as the example according to the present invention.
Figure 8A:
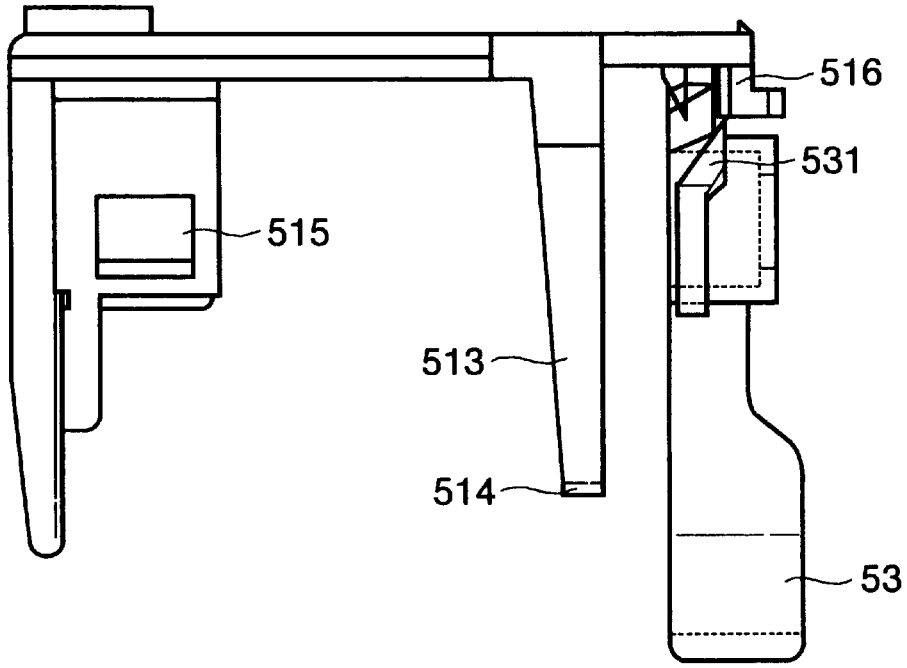
Figure 8B:
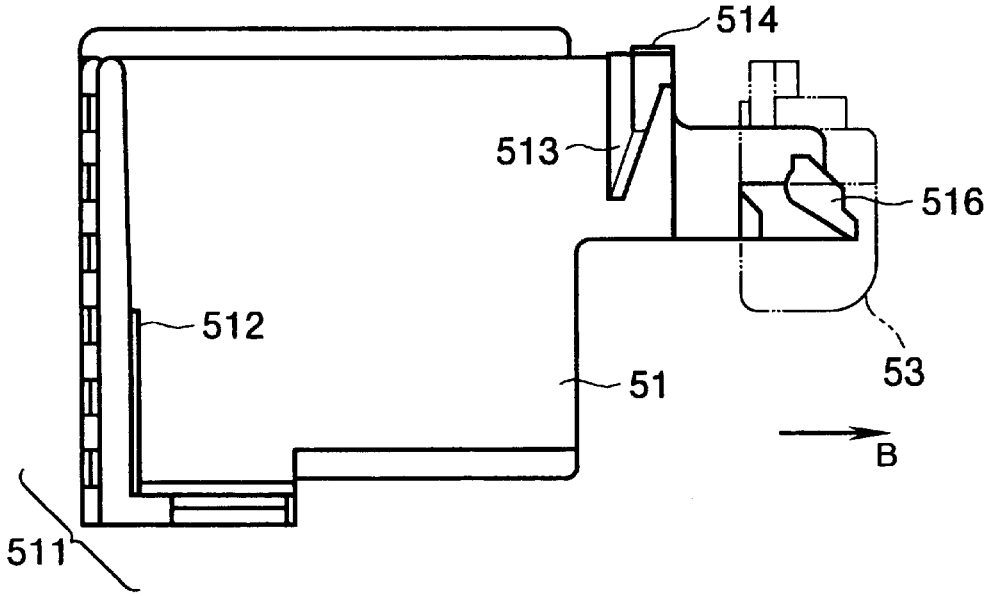
Figure 9A:
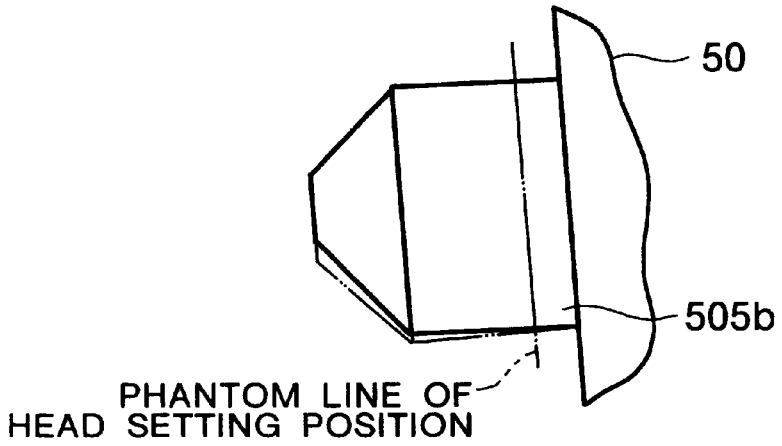
Figure 9B:
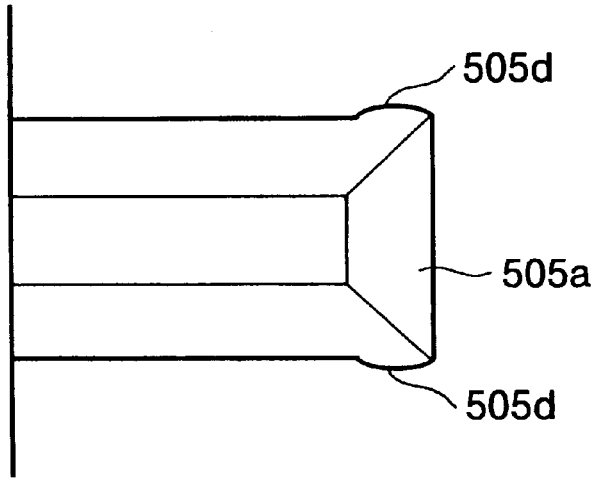
Figure 10A:
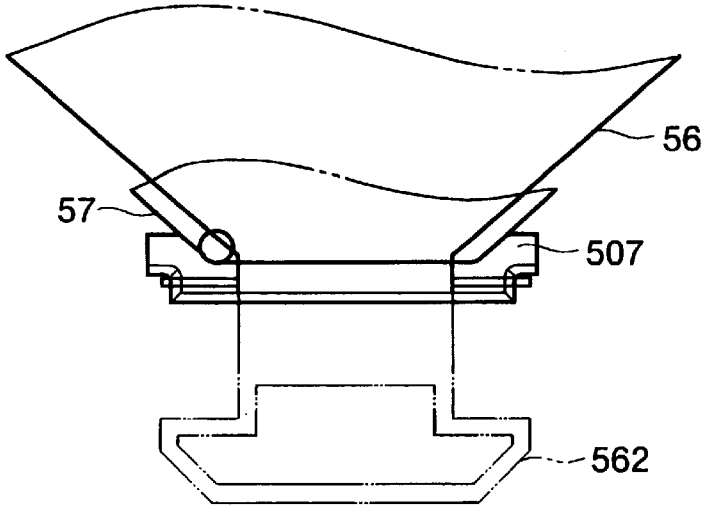
Figure 10B:
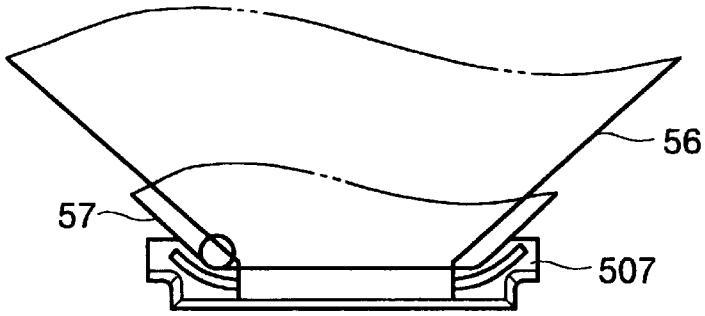
Figure 10C:
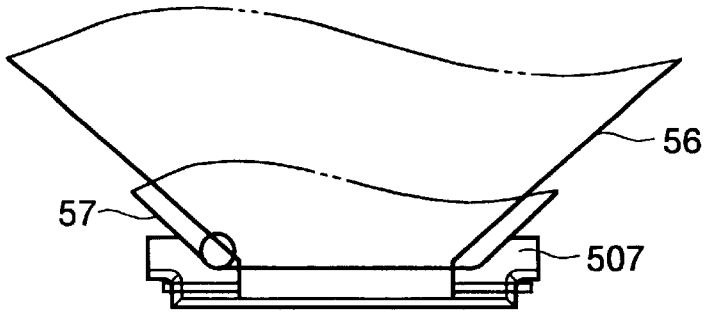

FIGS. 5A and 5B are front views of the carriage unit 15, wherein FIG. 5A shows a state before the head cartridge 7 is completely attached, and FIG. 5B shows a state where it has been completely attached. FIG. 6 is a plan view of the carriage unit 15. FIG. 7 is a view for explaining the constitution of the contact portion 503 of the carriage unit 15 (see FIG. 5A). FIGS. 8A and 8B are views for explaining the constitution of the main section of the mounting/dismounting mechanism of the head cartridge 7, wherein FIG. 8A is a plan view and FIG. 8B is a front view. FIGS. 9A and 9B are views for explaining the constitution of a fitting pin 505 of the head cartridge 7 for the carriage 50, wherein FIGS. 9A and 9B show the fitting pin provided at different sites, respectively. FIGS. 10A to 10C are views for explaining the built-in state of the leading end 562 of the flexible substrate 56, wherein FIG. 10A shows a state where the leading end 562 has been built in, and FIGS. 10B and 10C show the states where the leading end is during insertion process.

As shown in FIGS. 5A and 5B, the mounting/dismounting portion of the head cartridge 7 is comprised of the carriage 50, a head holder 51, a base cover 52, a hook lever 53, a contact spring 54, a hook cover 55, the flexible substrate 56, and a rubber pad 57 as shown in FIGS. 10A to 10C.

As shown in FIGS. 5A and 5B, the head holder 51 is constructed to slide left and right in the state where it holds the head cartridge 7 along the guide 501 (see FIG. 7) provided on the carriage 50. The head holder 51 is provided with a guide portion 511 for guiding the head cartridge 7, and a pressing portion 512 (see FIGS. 8A and 8B) for pressing the head cartridge 7 against a contact face 503 and locating faces 504 of a side plate 502 disposed vertically on the carriage 50. There are three locating faces for the side plate 502 of the carriage; two faces on a base plate near the nozzles of the head cartridge 7, and one face above the ink tank of the head cartridge 7. The contact face between the head cartridge 7 and the carriage 50 is configured to lie within a triangle formed of three points of those locating faces 504. A pressing position of the pressing portion 512 for the head holder 51 is inside this triangle. Also, at an opposed position of the pressing portion 512 for the head holder 51 is provided a guide arm 513, and in separating the head cartridge 7 from the contact face 503, this guide arm 513 operates on the head cartridge 7. On the side plate 502 of the carriage 50 is provided a rib 509 which is also used as the guide in mounting or dismounting the head cartridge 7, which rib serves to protect or hide the contact face 561 of the flexible substrate 56, as will be described later (see FIG. 7).

The head cartridge 7 of this example is provided with the guide on the side plate of the ink tank, and can be attached along an upper surface of the guide arm 513. And there is provided a concave portion in the guide of the head cartridge 7 at a predetermined position where the head cartridge 7 is attached, and there is a convex portion 514 as regulating means at a position corresponding to the head holder 51. Further, there is a convex portion on the bottom face of the head cartridge 7, and there is a concave portion 515 corresponding to the convex portion in a receiving portion corresponding to the head holder 51. Thereby, in mounting the head cartridge 7, the nozzle face 70 is not contacted by the platen, without causing any damage on the head cartridge 7. And a click sense in mounting can be obtained, so that the mounting operation can be improved. Also, due to hanging of the convex portion 514 of the head holder 51, the head cartridge 7 will not drop on the front surface in dismounting the head cartridge 7, or the instability after mounting, such as misalignment, can be eliminated.

As shown in FIGS. 5A and 5B, the hook lever 53 is attached rotatably to the side plate 503 of the carriage 50. A contact spring 54 is provided at the rotational center of the hook lever 53, biasing the hook lever 53 in a direction of the arrow A (see FIG. 3). The hook cover 55 is attached to cover the hook lever 53 to keep the hook lever 53 from getting out of the carriage 50. As shown in FIGS. 8A and 8B, the hook lever 53 and the head holder 51 have cams 516, 531 abutting each other, respectively, so that with the rotation of the hook lever 53, the head holder 51 is moved in a direction of the arrow B. Also, a biasing force of the contact spring 54 acts as a pressing force of the head holder 51 via the hook lever 53 onto the head cartridge 7.

On the side plate 502 of the carriage 50, there are provided fitting pins 505*a, b* for positioning the head cartridge 7. As shown in FIGS. 7, 9A and 9B, two fitting pins 505*a, b* are provided corresponding to the fitting holes of the base plate of the head cartridge 7. The base plate of the head cartridge 7 is inclined about from 1° to 4° to the scanning direction of the carriage unit 15 for the driving of the head cartridge 7. To cope with the fitting holes being inclined, one of the fitting holes of the base plate for the head cartridge 7 is made a square hole, and a corresponding fitting pin 505*a* on the carriage 50 side is made a square pin partly having a cylindrical shape. Further, a fitting pin 505*b* on the carriage side corresponding to a round hole is partly cut away corresponding to an undercut portion in the geometry of the carriage, allowing for the fitting therebetween at a position where the head cartridge 7 is abutted against the locating face 504 of the carriage. By doing so, the correct and smooth positioning of the head cartridge 7 with respect to the inclined base plate can be effected without needing any complex geometry of the structure.

As shown in FIG. 7, the contact face 503 (FIG. 5A) provided on the side plate 502 of the carriage 50 has the rubber pad 57 made of an elastic material such as silicon rubber having a rubber hardness of 30° to 50° (JIS specification) to make electrical connection with the head cartridge 7. And the contact portion 561 of the flexible substrate 56 is provided thereon. Both the rubber pad 57 and the flexible substrate 56 are positioned by the locating pin 506 provided on the side plate 502 of the carriage 50. On the reverse side of the contact portion 561 of the locating face on the flexible substrate 56 is provided a slit 563, for preventing any influence of deformation caused by assembling the flexible substrate 56 and the contact portion 561. A leading end 562 of the contact portion of the flexible substrate 56 is made narrower in conformance with the shape of the base plate for the head cartridge, and a hanging portion is provided at the end portion (see FIGS. 10A to 10C). In this way, the contact portion 561 is made triangular, with the decreasing number of contact pads provided closer to the leading end, making easy the forming of the signal line to attain the higher density. Further, the treatment of the leading end 562 of the flexible substrate 56 can be facilitated. On the side plate 502 of the carriage 50 is provided a slit hole 507 into which the leading end 562 of the flexible substrate 56 is inserted. As shown in FIG. 10B, this leading end 562 is bent and inserted into the slit hole 507. Through the slit hole 507, the leading end is straightened and will not be slipped off due to fastening, as shown in FIG. 10C. With this constitution, since the leading end is free, and the contact face 561 of the flexible substrate 56 is not stiff, its good contact with the contact face of the head cartridge can be established. If the head cartridge 7 is mounted, the contact face 503 of the carriage 50 is entered into a cutout portion of the base plate for the head cartridge 7, and brought into contact with the contact face on the substrate formed inside the cutout portion.

As shown in FIGS. 5A and 5B, the flexible substrate 56 is extended along the side plate of the carriage 50, bent vertically, and anchored to the carriage 50 by the base cover 52. The flexible substrate 56 is provided with a convex portion 563 for temporary fixation, so that the flexible substrate 56 is secured by affixing the convex portion 563 to the carriage 50, whereby the assembling can be efficiently made in attaching the base cover 52. Further, the base cover 52 is provided with the presser bars 521 so that the pins 506 on the carriage 50 may not get out of the locating holes of the rubber pad 57 and the flexible substrate 56. Also, the head cartridge 7 of the invention is provided with a recess portion 731 to escape a bulge portion of the locating pins 506 and the pressure bars 521 for the base cover 52. Accordingly, the length of locating pins 506, and the thickness of presser bars 503 for the base cover 52 can be worked, allowing for the secure positioning of the rubber pad 57 and the flexible substrate 56 or the prevention of loosening. The flexible substrate 56 is secured to the chassis 8 by a flexible anchor plate 85, with its curvature changed with the position of the carriage unit 15, whereby a head drive signal from the electrical substrate 9 is passed to the head cartridge 7, corresponding to the movement of the carriage 15.

With the above constitution, the mounting/dismounting of the head cartridge 7 to or from the carriage 15, holding, positioning and the electrical contact thereof can be easily made.

Next, the operation of exchanging the head cartridge 7 will be described. When the ink within the head cartridge is used up, and when the exchange of a color recording head cartridge in use is required, the operator depresses a predefined key switch for the exchange of the head cartridge. Normally, the head cartridge is on standby at a capping position, but the carriage is thereby moved to a head cartridge exchange position.

FIGS. 5A and 5B show front views of the carriage unit 15 in mounting/dismounting the head cartridge. In mounting the head cartridge 7, the hook lever 53 is turned upward as shown in the figure, so that the head holder 51 is brought to the left side in the figure (i.e., left to the printer body), allowing the head cartridge 7 to be mounted (FIG. 5A). In this state, the head cartridge 7 is mounted on the head holder 51, and the hook lever 53 is turned downward, so that the head holder 51 together with the head cartridge 7 is moved to the right side to effect the positioning and electrical contact of the head cartridge 7 (FIG. 5B). In this state, the image can be formed on the recording sheet P. Further, when the head cartridge 7 is removed from the carriage unit 15, the hook lever 53 is turned upward as shown in FIG. 5A to cause the head holder 51 to be moved to the left side. Thereby, the guide arm 513 of the head holder 51 forces the head cartridge 7 to the left side, so that the head cartridge 7 is removed from the contact portion of the carriage 15. In this state, the operator can take out the head cartridge 7 vertically to a sliding direction of the head holder 51. At the head cartridge exchange position, the concave portion 41*a* as shown in FIG. 1 is provided on the circumference of the paper exhausting roller at a position opposite a face plane of the head cartridge 7. The depth is 0.5 mm, and the width is greater than that of the face plane of the head cartridge 7 plus a slide amount required to unfit the head cartridge 7. Accordingly, there is less risk that the operator causes the face plane of the head cartridge 7 to rub against the paper exhausting roller, resulting in less degraded recording quality caused by damaging the face plane of the head cartridge. Further, when the operator mounts a new head cartridge 7, there is also less risk that the operator rubs against the face plane of the head cartridge in the same manner as above described. And if the hook lever 53 is turned downward as shown in FIG. 5A, the head holder 51 together with the head cartridge 7 is moved to the right side, so that the positioning and electrical contact of the head cartridge 7 can be effected. If the operator depresses the key switch for the exchange of head cartridge again after the exchange of the head cartridge, the carriage returns to the capping position to effect the capping.

Above the carriage 50, a paper distance adjusting portion 58 for adjusting the gap between the head cartridge 7 and the recording sheet is provided (see FIG. 6). The paper distance adjusting portion is comprised of an adjusting lever 581, a pressure contact lever 582, a pressure contact spring 583, and a top cover 584.

The adjusting lever 581 is made rotatable around a pin inserted into a hole provided on the carriage 50. The adjusting lever 581 is provided with a sliding surface 585 of polygonal shape located at different distances away from the rotational center of the adjusting lever, depending on the number of paper distance positions. The pressure contact lever 582 is rotatable around the pin provided on the carriage 50, biasing the sliding surface 585 of the adjusting lever 581 toward the guide rail 82 by the pressure contact spring 583. By changing the sliding surface 585 of the adjusting lever 581, the carriage 50 is rotated around the guide shaft, so that the paper distance can be changed. The top cover 584 is secured to the carriage 50 by the pawls provided on both sides thereof to hold the adjusting lever 581 and the pressure contact lever 582. Further, the leading end of the adjusting lever 581 has the elasticity to secure the adjusting lever 581 in cooperation with a groove 586 of the top cover 584 to have a predetermined paper distance.

The carriage unit 15 can be scanned reciprocally through a bearing of the carriage 50 along the guide shaft attached to the chassis 8 and by sliding the adjusting lever 581 and the pressure contact lever 582 along the guide rail 82 attached to the same chassis 8. On a back surface of the carriage 50, a timing belt 83 is attached. The timing belt 83 is suspended around a pulley (not shown) attached on the shaft of the carriage motor installed on the chassis 8 and an idle pulley 84 attached to the chassis 8 and stretching the timing belt 83 (see FIG. 2).

Herein, the positional relation will be briefly explained with reference to FIGS. 2 to 4.

FIG. 4 is a front view of an ink jet printer, where a front cover 105 as an opening/closing member covers the printer, there are seen discriminably a power supply key 101 which is a first pressing part, a reset key 102 for resetting the ink jet printing members, and the LED lamps 103, 104 for the indication thereof, all of which form an outer casing operation area. Reference numeral 112 is a tray of the drawer type to receive the recording medium which has been recorded. In FIG. 4, there is observed exhausting means comprised of an exhausting roller in an exhausting region of the recording medium. In FIG. 2, in contrast to FIG. 4, this front cover 105 is opened to expose an operation key 100 (a second pressing part) for moving the carriage from an end portion of the movement area of the carriage (where the carriage is covered with a shield member 106 to substantially inhibit the ink jet printing members from being removed from the carriage) to an exchange region where the ink jet printing members can be mounted or dismounted onto or from the carriage. The operation key 100 has a light bright color of moss green, different from the peripheral portion of gray and white, and is greater in size than the operation keys 101, 102. The operation key 100 is disposed upward in the movement range of the carriage, and located about 50 mm apart from the end portion of the carriage 15 in the exchange region as shown in the figure (or it is only necessary to be 30 mm or more apart from the exchange region in the movement direction of the carriage), thereby enhancing the operability.

Briefly stating this constitution, the ink jet printer comprises a scan-type carriage moving with the ink jet printing members mounted thereon, moving means for moving the carriage at least from the end portion of the movement area of the carriage to the exchange region where the ink jet printing members can be mounted or dismounted onto or from the carriage, an opening/closing member for opening or closing at least the exchange region, characterized in that the moving means can be manually operated, using an operation key provided at a position received within the printer in a closed state of the opening/closing member, and operable in an open state thereof, only where the opening/closing member is in the open state. With this constitution, it is eliminated that the carriage is moved to the exchange region unnecessarily, and premising that the opening/closing cover is opened in the exchange or mounting/dismounting operation, the operability can be further enhanced.

Referring to FIG. 3, and FIGS. 11 to 14C, it is seen that the keys 101, 102 on the operation unit are always exposed to the outside, but the operation key 100 is manipulated in a different direction from the exposed keys 101, 102 on the operation unit (arrows 115, 120), and the lever portions (121, 110) are displaced by the operation of the key 100 and the exposed key 101, 102 each of which is provided as an integral unit having an elastic deformation region (124, 117) for regulation on the lever portion itself, respectively, so that the lever portions can be individually displaced, as will be described further on.

Figure 14A:
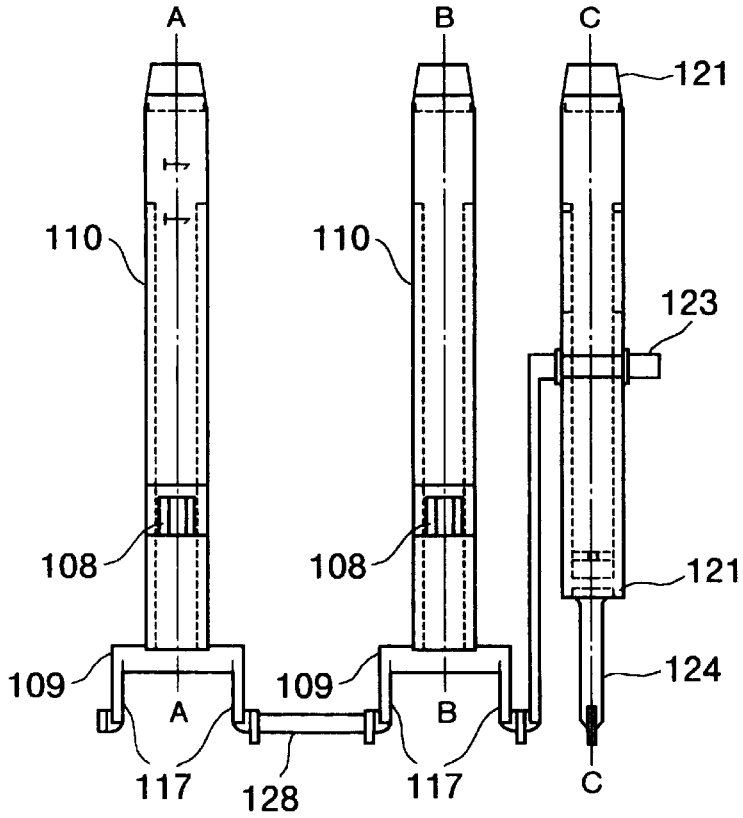
FIGS. 14A to 14C are upper views showing a link structure of the key in the example of the present invention.
Figure 14B:
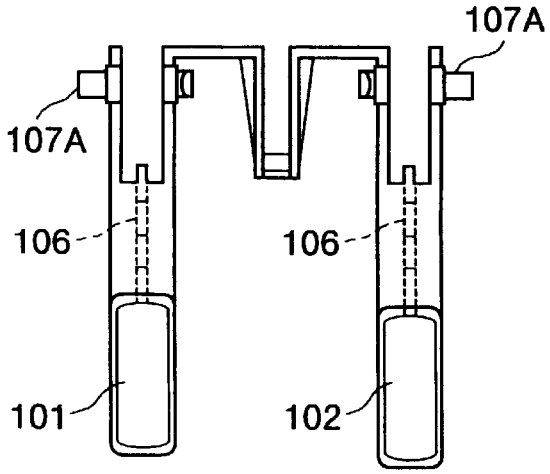
Figure 14C:
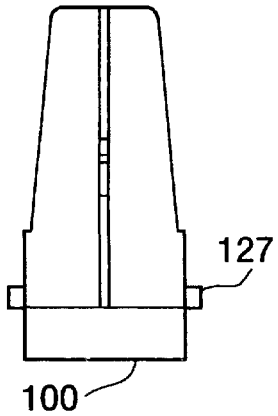

A switching mechanism as described below has three members as shown in FIGS. 14A, 14B and 14C to effect the pressing operation of respective switches 111A, 111B, 122 within the housing of apparatus.

Figure 11:
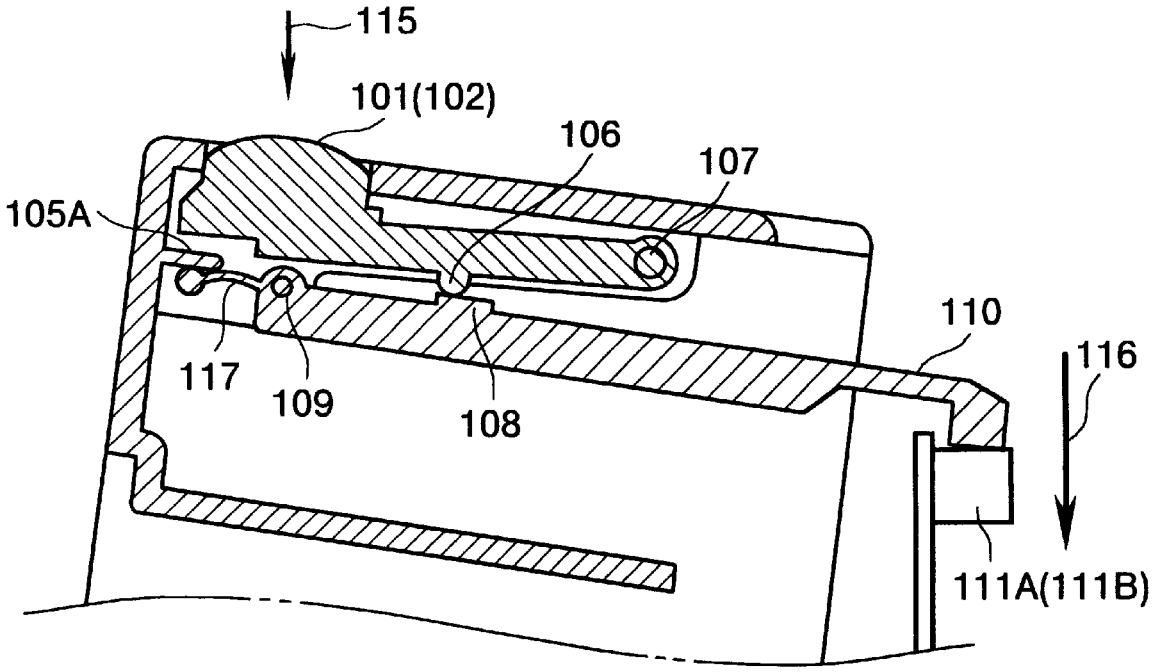
FIG. 11 is a cross-sectional view showing the structure of a key in the example of the invention.

FIG. 11 is a typical cross-sectional view of the apparatus including a plane vertical to the paper face and the line A—A of FIG. 14A. Note that a typical cross-sectional view of apparatus including a plane vertical to the paper face and the line B—B of FIG. 14A is the same.

Figure 12:
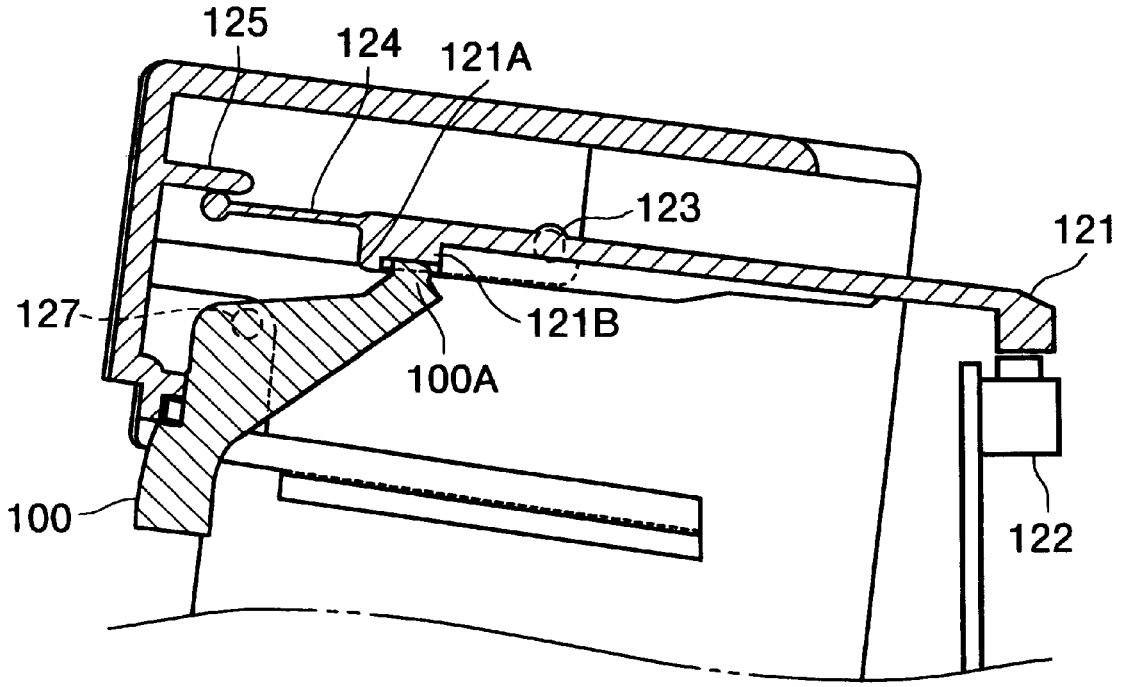
FIG. 12 is a cross-sectional view showing the structure of the key in the example of the invention.
Figure 13:
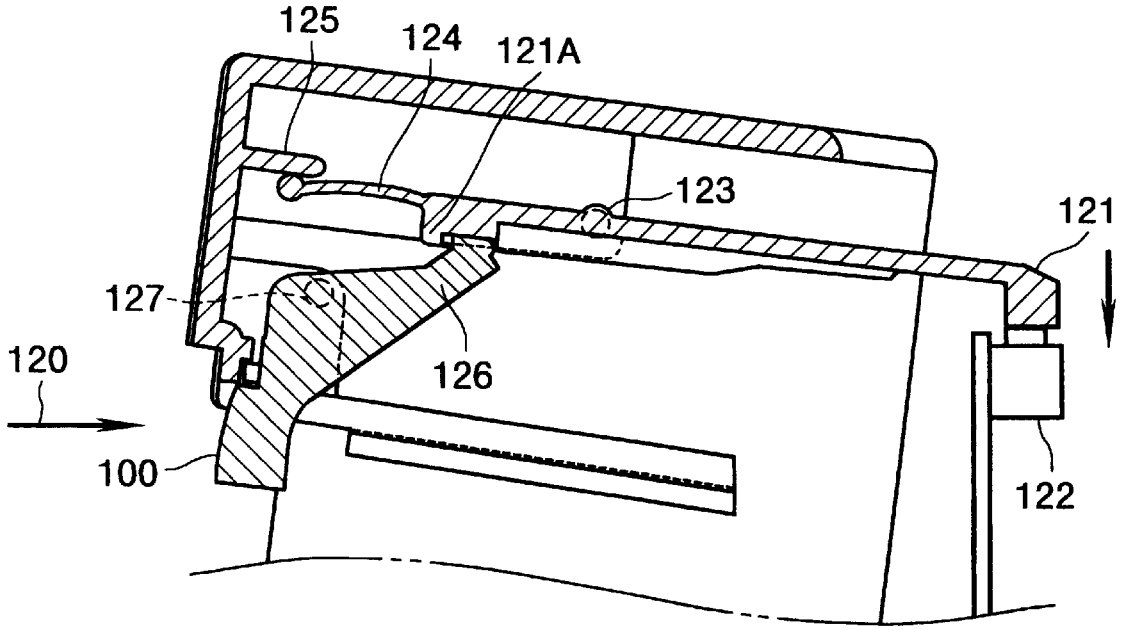
FIG. 13 is a cross-sectional view showing the structure of the key in the example of the invention.

Also, FIGS. 12 and 13 are typical cross-sectional views of apparatus including a plane vertical to the paper face and the line C—C of FIG. 14A.

In FIG. 11, an elastic deformation region 117 of the lever 110 always abutting against a projection 105A of the printer itself is deformed when the lever 110 is rotated by the key 101 being depressed in a direction of the arrow 115 around a rotational central axis of the lever 110, thereby pressing a switch 111(A) or switch 111(B) down. Thereafter, the lever is returned to the state of FIG. 3 owing to an elastic force produced by its deformation. The switch 111 produces a signal with one operation of this lever, which is then sent to control means, not shown. The key 101 is rotatable around a rotational center A bearing on an axis 107 of the printer itself, passing a force upon a projection 106 as a pressing force receiving portion abutting against a receiving portion 108 of the lever 110.

In FIGS. 12 and 13, for the exchange operation key 100 of the ink jet printing members, the elastic deformation area 124 of the lever 121 always abutting against the projection 125 of the printer itself is deformed when the lever 121 is rotated by the key 100 being depressed in a direction of the arrow 120 around a rotational central axis 123 of the lever, pressing the switch 122 down. Thereafter, owing to an elastic force produced by its deformation, the lever returns to the state of FIG. 12. The switch 122 generates a signal with one operation of this lever, which is then sent to control means, not shown. The key 100 is rotatable around a rotational central axis 127 through a bearing portion of the printer itself, passing a force upon the projection 100A abutting against a receiving portion 121B of the lever 121. This receiving portion has a projection 121A as a pressing force receiving portion which is also used as a stopper to prevent the slippage therefrom.

Since the levers corresponding to three switches are integrated, with the same displacement, as shown in FIGS. 14A, 14B and 14C, the above example accomplishes the miniaturization of the apparatus with the simplified constitution.

Specifically, a mechanism section for transmitting the operation of key 101 to the switch 111A, and a mechanism section for transmitting the operation of key 102 to the switch 111B are connected by a connecting portion 128, and further connected with a mechanism section for transmitting the operation of key 100 to the switch 122 by a connecting portion 129. Since the mechanism sections including the connecting portions are constructed such that each key operation may not be transmitted to adjacent mechanism sections, no key operation is transmitted to switches other than the switch corresponding to its own key operation, to cause a malfunction.

Figure 15:
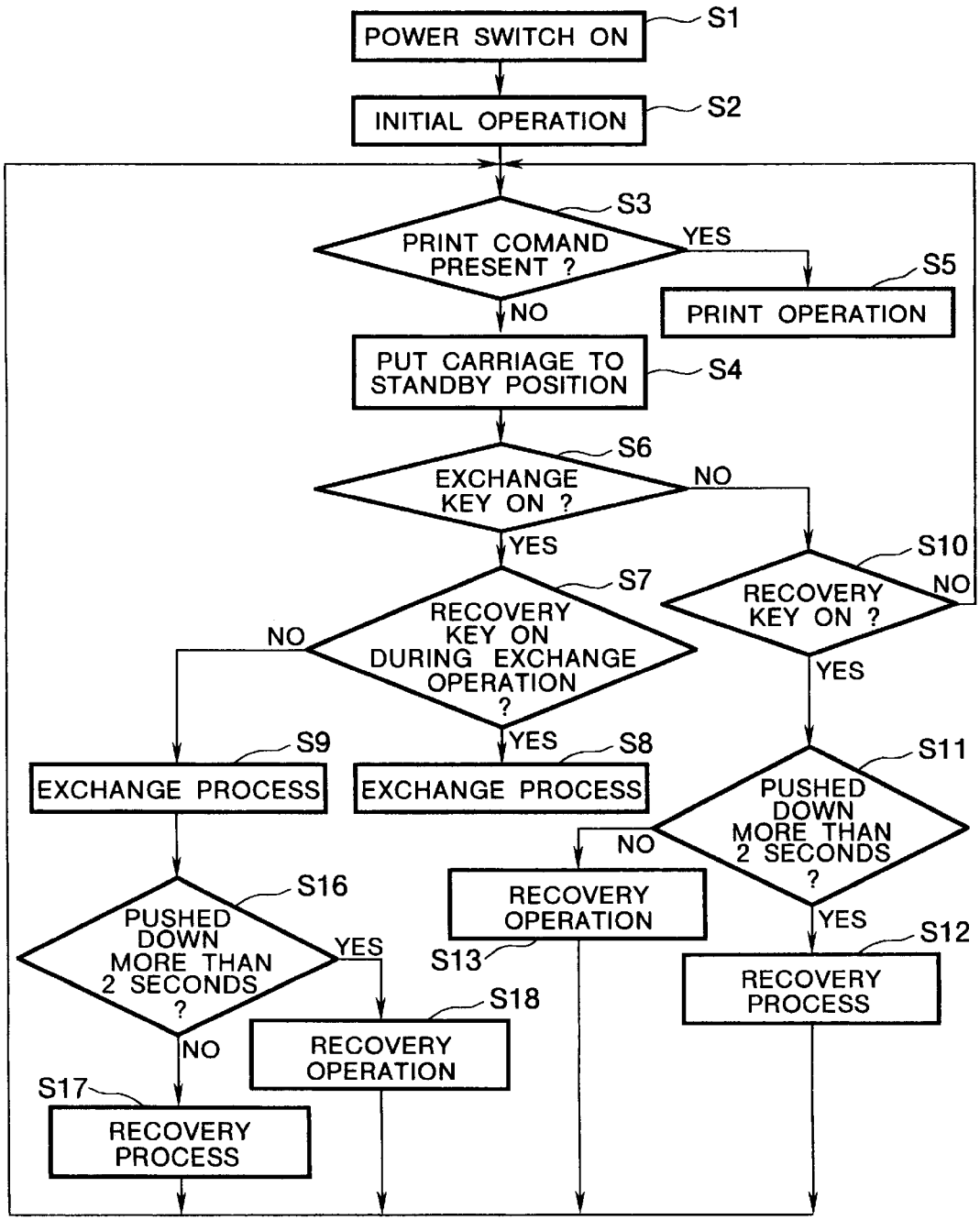
FIG. 15 is a flowchart showing the operation with the operation key in the example of the present invention.

FIG. 15 is a flowchart with the above operation key, wherein one example for controlling the printer according to this flow is presented, as clearly seen without explanation. It should be noticed in this flowchart that the previously operated key is given priority while the power supply is turned on, and it is apparent that the present invention is particularly effective in this case.

In this example, an operation key for moving the carriage to the exchange region for the exchange or mounting/dismounting of the ink jet printing members provided at a position received within the printer in a closed state of the opening/closing member and operable in an open state thereof, can be operated manually only when the opening/closing member is in the open state, whereby the wasteful malfunction or the waste of ink or time can be avoided.

What is claimed is:

1. A recording apparatus operable in combination with a recording head, said recording apparatus comprising:

a housing;

a carriage within said housing for reciprocating said recording head carried thereon;

an accommodation space for accommodating a reciprocative movement area of said carriage, disposed inside said housing;

a cover member connected to said housing for opening or closing at least part of said accommodation space to or from outside of said housing;

an opening portion for communicating at least part of said accommodation space to the outside of said housing, formed by a relative displacement of said cover member from said housing; and an electrical switch key for causing movement of said carriage to a predetermined position in said accommodation space where said carriage is directly manipulable by an operator through said opening portion from an exterior of said housing, said electrical switch key being visible and directly operable through said opening portion formed in accordance with the displacement of said cover member, said electrical switch key being provided outside of the predetermined position as an end of an exchange movement area of said carriage and at a position where the operator handling said electrical switch key can be prevented from being in contact with said carriage.

2. A recording apparatus according to claim 1, wherein said carriage is movable to a position at which said recording head maintains or recovers a recording function, within said accomodation space separated apart from the position within said accomodation space in communication to the outside of said housing through said opening portion.

3. A recording apparatus according to claim 1, wherein said recording head comprises an ink jet recording head for discharging ink through ink discharge ports.

4. A recording apparatus according to claim 3, wherein said carriage is movable to a position at which said ink jet recording head maintains or recovers an ink discharge function, within said accomodation space separated apart from the postion within said accomodation space in communication to the outside of said housing through said opening portion.

5. A recording apparatus according to claim 1, wherein said recording head comprises an ink jet recording head comprising electricity-heat converters for discharing ink through ink discharge ports by using heat energy generated by said electricity-heat converters.

6. A recording apparatus according to claim 5, wherein said carriage is movable to a position at which said ink jet recording head maintains or recovers an ink discharge function, within said accomodation space separated apart from the position within said accomodation space in communication to the outside of said housing through said opening portion.

7. A recording apparatus according to claim 1, wherein said electrical switch key is of a light, bright color different from colors of a surrounding portion.

8. A recording apparatus according to claim 1, further comprising an operation unit which is always exposed externally and includes exposed keys, said electrical switch key being depressed in a different direction from said exposed keys in said operation unit, said electrical switch key and said exposed keys being each provided with a lever portion displaceable by being subjected to a respective operation as an integral unit having an elastic deformation region on said lever portion itself, so that each of the lever portions can be individually displaced.

9. A recording apparatus operable in combination with a recording head, said recording apparatus comprising:

a housing;

a carriage within said housing for reciprocating said recording head carried thereon;

an accommodation space for accommodating a reciprocative movement area of said carriage, disposed inside said housing;

a cover member connected to said housing for opening or closing at least part of said accommodation space to or from outside of said housing;

an opening portion for communicating at least part of said accommodation space to the outside of said housing, formed by a relative displacement of said cover member from said housing; and an electrical switch key visible through said opening portion and directly pressable by an operator when said cover member opens said opening portion for driving a carriage drive motor so as to move said carriage to a position within said accommodation space in communication to the outside of said housing through said opening portion, wherein said electrical switch key is provided at a position in a movement direction of said carriage apart from an exchange movement area extending from an end portion of said carriage to an exchange region, and wherein the position at which said electrical switch key is provided is 30 mm or greater apart from the exchange region in the movement direction of said carriage.

10. A recording apparatus according to claim 9, wherein said carriage is movable to a position at which said recording head maintains or recovers a recording function, within said accommodation space separated apart from the position within said accommodation space in communication to the outside of said housing through said opening portion.

11. A recording apparatus according to claim 9, wherein said recording head comprises an ink jet recording head for discharging ink through ink discharge ports.

12. A recording apparatus according to claim 11, wherein said carriage is movable to a position at which said ink jet recording head maintains or recovers an ink discharge function, within said accommodation space separated apart from the position within said accommodation space in communication to the outside of said housing through said opening portion.

13. A recording apparatus according to claim 9, wherein said recording head comprises an ink jet recording head comprising electricity-heat converters for discharging ink through ink discharge ports by using heat energy generated by said electricity-heat converters.

14. An ink jet printer having a scan-type carriage for moving ink jet printing members carried thereon, and an opening/closing member for opening or closing at least an exchange region, comprising:

moving means for moving said carriage at least from an end portion of a movement area of said carriage to the exchange region where said ink jet printing members can be mounted onto or dismounted from said carriage;

an operation key provided at a position enclosed within the printer in a closed state of said opening/closing member, said operation key being operable only when said opening/closing member is in an open state, said operation key comprising an electrical switch key operable by an operator to control said moving means so as to move said carriage to the exchange region; and an operation unit which is always exposed externally and includes an exposed key, wherein said operation key is depressed in a different direction from said exposed key in said operation unit, and said operation key and said exposed key are each provided with a lever portion displaceable by being subjected to a respective operation as an integral unit having an elastic deformation region on said lever portion itself, so that each of the lever portions can be individually displaced.

15. An ink jet printer according to claim 14, wherein said operation key is of a light, bright color different from colors of a surrounding portion.

16. An ink jet printer according to claim 14, wherein said operation key is provided at a position in a movement direction of said carriage apart from a movement area extending from the end portion of said carriage to the exchange region.

17. An ink jet printer according to claim 16, wherein the position at which said operation key is provided is 30 mm or greater apart from the exchange region in the movement direction of said carriage.

18. A switching mechanism for a recording operation for use with a recording apparatus, comprising:

a plurality of elements for making electrical connection by receiving pressing forces from a same direction;

a first pressing portion pressable by an operator in a first direction;

a second pressing portion pressable by an operator in a second direction different from the first direction; and a transmission member for transmitting a first pressing force acting on said first pressing portion and a second pressing force acting on said second pressing portion to different elements of said plurality of elements, wherein said transmission member directs both the first pressing force from said first pressing portion and the second pressing force from said second pressing portion to press said different elements of said plurality of elements in the same direction.

19. A switching mechanism according to claim 18, wherein said transmission member has a center of rotation, a regulating portion with an elasticity at one end portion from the center of rotation for regulating rotation, a pressing force receiving portion disposed at another end portion from the center of rotation, and a transmission portion for transmitting a pressing force from said pressing force receiving portion to said elements, disposed at a leading end on a side of the other end portion.

20. A switching mechanism according to claim 18, wherein said transmission member comprises a first transmission portion where a first rotation fulcrum, a point of application by the first pressing force and a point of application for pressing said elements are arranged in this order, and a second transmission portion where a point of force applied with said second pressing force, a second rotation fulcrum and a point of application for pressing said elements are arranged in this order.

21. An ink jet printer comprising:

a carriage for reciprocating an ink jet recording head for recording on a recording medium along the recording medium, said ink jet recording head discharging ink through ink discharge ports, a head home position provided within a movement area of said carriage and outside a recording area where said ink jet recording head performs the recording on the recording medium;

an apparatus housing for housing the movement area of said carriage internally;

a lid member for covering the movement area of said carriage;

a plurality of elements for making electrical connection by being subjected to pressing forces from a same direction, said plurality of elements disposed within said housing;

a first pressing portion pressable by an operator in a first direction, said first pressing portion disposed on an outer surface of said housing;

a second pressing portion pressable by an operator in a second direction different from the first direction, said second pressing portion disposed within said housing covered with said lid member; and a transmission member for transmitting a first pressing force acting on said first pressing portion and a second pressing force acting on said second pressing portion to different elements of said plurality of elements, said transmission member disposed within said housing, wherein said transmission member directs both the first pressing force from said first pressing portion and the second pressing force from said second pressing portion to press said different elements of said plurality of elements in the same direction.

22. An ink jet printer according to claim 21, wherein said transmission member has a center of rotation, a regulating portion with an elasticity at one end portion from the center of rotation for regulating rotation, a pressing force receiving portion disposed at another end portion from the center of rotation, and a transmission portion for transmitting a pressing force from said pressing force receiving portion to said elements, disposed at a leading end on a side of the other end portion.

23. An ink jet printer according to claim 21, wherein said second pressing portion comprises an operation key for moving said carriage to inside of said carriage movement area spaced apart from the home position.

24. An ink jet printer according to claim 21, wherein said second pressing portion comprises an operation key for moving said carriage to the carriage movement area between the home position and a position near said second pressing portion.

25. An ink jet printer according to claim 21, wherein said ink jet recording head discharges the ink using heat energy, with electricity-heat converters for generating the heat energy to be applied to the ink.

26. An ink jet printer according to claim 24, wherein said transmission member comprises a first transmission portion where a first rotation fulcrum, a point of application by the first pressing force and a point of application for pressing said elements are arranged in this order, and a second transmission portion where a point of force applied with said second pressing force, a second rotation fulcrum and a point of application for pressing said elements are arranged in this order.

27. A printer having a scan-type carriage for moving printing members carried thereon, and an opening/closing member for opening or closing at least an exchange region, comprising:

moving means for moving said carriage at least from an end portion of a movement area of said carriage to the exchange region where said printing members can be mounted onto or dismounted from said carriage;

an operation key provided at a position enclosed within the printer in a closed state of said opening/closing member, said operation key being operable only when said opening/closing member is in an open state, said operation key comprising an electrical switch key operable by an operator to control said moving means so as to move said carriage to the exchange region; and an operation unit which is always exposed externally and includes an exposed key, wherein said operation key is depressed in a different direction from said exposed key in said operation unit, and said operation key and said exposed key are each provided with a lever portion displaceable by being subjected to a respective operation as an integral unit having an elastic deformation region on said lever portion itself, so that each of the lever portions can be individually displaced.

28. A printer according to claim 27, wherein said operation key is of a light, bright color different from colors of a surrounding portion.

29. A printer according to claim 27, wherein said operation key is provided at a position in a movement direction of said carriage apart from a movement area extending from the end portion of said carriage to the exchange region.

30. A printer according to claim 29, wherein the position at which said operation key is provided is 30 mm or greater apart from the exchange region in the movement direction of said carriage.

31. A recording apparatus having a switching mechanism, said switching mechanism being used for a recording operation, said switching mechanism comprising:

a plurality of elements for making electrical connection by receiving pressing forces from a same direction;

a first pressing portion pressable by an operator in a first direction;

a second pressing portion pressable by an operator in a second direction different from the first direction; and a transmission member for transmitting a first pressing force acting on said first pressing portion and a second pressing force acting on said second pressing portion to different elements of said plurality of elements, wherein said transmission member directs both the first pressing force from said first pressing portion and the second pressing force from said second pressing portion to press said different elements of said plurality of elements in the same direction.

32. A recording apparatus according to claim 31, wherein said transmission member has a center of rotation, a regulating portion with an elasticity at one end portion from the center of rotation for regulating rotation, a pressing force receiving portion disposed at another end portion from the center of rotation, and a transmission portion for transmitting a pressing force from said pressing force receiving portion to said elements, disposed at a leading end on a side of the other end portion.

33. A recording apparatus according to claim 31, wherein said transmission member comprises a first transmission portion where a first rotation fulcrum, a point of application by the first pressing force and a point of application for pressing said elements are arranged in this order, and a second transmission portion where a point of force applied with said second pressing force, a second rotation fulcrum and a point of application for pressing said elements are arranged in this order.

34. A recording apparatus having a carriage moving mechanism for moving a carriage mounting a head member, said apparatus including a switching mechanism, said switching mechanism comprising:

a plurality of elements for making electrical connection by receiving pressing forces from a same direction;

a first pressing portion pressable by an operator in a first direction;

a second pressing portion pressable by an operator in a second direction different from the first direction; and a transmission member for transmitting a first pressing force acting on said first pressing portion and a second pressing force acting on said second pressing portion to different elements of said plurality of elements, wherein said transmission member directs both the first pressing force from said first pressing portion and the second pressing force from said second pressing portion to press said different elements of said plurality of elements in the same direction.

35. A recording apparatus according to claim 34, wherein said transmission member has a center of rotation, a regulating portion with an elasticity at one end portion from the center of rotation for regulating rotation, a pressing force receiving portion disposed at another end portion from the center of rotation, and a transmission portion for transmitting a pressing force from said pressing force receiving portion to said elements, disposed at a leading end on a side of the other end portion.

36. A recording apparatus according to claim 34, wherein said transmission member comprises a first transmission portion where a first rotation fulcrum, a point of application by the first pressing force and a point of application for pressing said elements are arranged in this order, and a second transmission portion where a point of force applied with said second pressing force, a second rotation fulcrum and a point of application for pressing said elements are arranged in this order.

37. A printer comprising:

a carriage for reciprocating a recording head for recording on a recording medium along the recording medium, a head home position provided within a movement area of said carriage and outside a recording area where said recording head performs the recording on the recording medium;

an apparatus housing for housing the movement area of said carriage internally;

a lid member for covering the movement area of said carriage;

a plurality of elements for making electrical connection by being subjected to pressing forces from a same direction, said plurality of elements disposed within said housing;

a first pressing portion pressable by an operator in a first direction, said first pressing portion disposed on an outer surface of said housing;

a second pressing portion pressable by an operator in a second direction different from the first direction, said second pressing portion disposed within said housing covered with said lid member; and a transmission member for transmitting a first pressing force acting on said first pressing portion and a second pressing force acting on said second pressing portion to different elements of said plurality of elements, said transmission member disposed within said housing, wherein said transmission member directs both the first pressing force from said first pressing portion and the second pressing force from said second pressing portion to press said different elements of said plurality of elements in the same direction.

38. A printer according to claim 37, wherein said transmission member has a center of rotation, a regulating portion with an elasticity at one end portion from the center of rotation for regulating rotation, a pressing force receiving portion disposed at another end portion from the center of rotation, and a transmission portion for transmitting a pressing force from said pressing force receiving portion to said elements, disposed at a leading end on a side of the other end portion.

39. A printer according to claim 37, wherein said second pressing portion comprises an operation key for moving said carriage to inside of said carriage movement area spaced apart from the home position.

40. A printer according to claim 37, wherein said second pressing portion comprises an operation key for moving said carriage to the carriage movement area between the home position and a position near said second pressing portion.

41. A printer according to claim 27, wherein said recording head discharges ink using heat energy, with electricity-heat converters for generating the heat energy to be applied to the ink.

42. A printer according to claim 37, wherein said transmission member comprises a first transmission portion where a first rotation fulcrum, a point of application by the first pressing force and a point of application for pressing said elements are arranged in this order, and a second transmission portion where a point of force applied with said second pressing force, a second rotation fulcrum and a point of application for pressing said elements are arranged in this order.

43. A method of operating a recording apparatus operable in combination with a recording head, said method comprising the steps of:

providing the recording apparatus comprising a housing, a carriage within the housing for reciprocating the recording head carried thereon, an accomodation space for accomodating a reciprocative movement area of the carriage, disposed inside the housing, a cover member connected to the housing for opening or closing at least part of the accomodation space to the outside of the housing, formed by a relative displacement of the cover member from the housing, and an electrical switch key visible and directly operable through the opening portion, the electrical switch key being provided outside of a predetermined position as the end of an exchange movement area of the carriage and at a position where an operator handling the electrical switch key can be prevented from being in contact with the carriage; and causing movement of the carriage to the predetermined position in the accomodation space where the carriage is directly manipulable by the operator through the opening portion from an exterior of the housing by displacing the cover member and operating the electrical switch key.

* * * * *

UNITED STATES PATENT AND TRADEMARK OFFICE

CERTIFICATE OF CORRECTION

PATENT NO. : 6,027,212
DATED : February 22, 2000
INVENTOR(S) : Tanno et al.

It is certified that error appears in the above-identified patent and that said Letters Patent is hereby corrected as shown below:

Column 12:
Line 7, "accomodation" should read -- accommodation --.
Line 8, "accomodation" should read -- accommodation --.
Line 13, "discharing" should read -- discharging --.
Line 19, "accomodation" should read -- accommodation --.
Line 20, "accomodation" should read -- accommodation --.

Column 15:
Line 14, "claim 24," should read -- claim 21, --.

Column 18:
Line 5, "claim 27," should read -- claim 37, --.
Line 23, "accomodation" should read -- accommodation --.
Line 24, "accomodating" should read -- accommodating --.
Line 27, "accomodation" should read -- accommodation --, and "to the" should read -- to or from outside of the housing, an opening portion for communicating at least part of the accommodation space to the --.
Line 38, "accomodation" should read -- accommodation --.

Signed and Sealed this

Twenty-first Day of August, 2001

*Attest:*

Nicholas P. Godici

*Attesting Officer*

NICHOLAS P. GODICI
*Acting Director of the United States Patent and Trademark Office*